US005524534A

United States Patent [19]

Dietel

[11] Patent Number: 5,524,534

[45] Date of Patent: Jun. 11, 1996

[54] DUAL HYDRAULIC CYLINDER COMPACTING APPARATUS

[76] Inventor: Dale G. Dietel, 4880 County Rd. 10 East, Chaska, Minn. 55318

[21] Appl. No.: 515,509

[22] Filed: Aug. 15, 1995

[51] Int. Cl.[6] ..... B30B 7/00

[52] U.S. Cl. ..... 100/209; 100/215; 100/218; 100/244

[58] Field of Search ..... 100/48, 186, 209, 100/215, 218, 244, 269.14

[56] References Cited

U.S. PATENT DOCUMENTS

| | | | |
|---|---|---|---|
| 1,822,939 | 9/1931 | Stout | 425/149 |
| 2,067,401 | 1/1937 | Lassman | 264/294 |
| 2,359,674 | 10/1944 | Pollock | 425/420 |
| 2,697,979 | 12/1954 | MacMurray | 100/244 |
| 2,830,530 | 4/1958 | Powell | 100/244 |
| 2,892,397 | 6/1959 | Finkelstein . | |
| 3,168,033 | 2/1965 | Hansen | 100/116 |
| 3,179,998 | 4/1965 | Lamb | 425/419 |
| 3,183,570 | 5/1965 | Vogt | 264/86 |
| 3,554,117 | 1/1971 | Goldkuhle | 100/209 |
| 3,618,707 | 11/1971 | Sluhan | 184/1 E |
| 3,752,059 | 8/1973 | Boyer | 100/209 |
| 4,232,600 | 11/1980 | Le Jeune | 100/37 |
| 4,303,412 | 12/1981 | Baikoff | 100/37 |
| 4,346,653 | 8/1982 | Rodak | 100/37 |
| 4,373,889 | 2/1983 | Brown | 425/150 |
| 4,389,928 | 6/1983 | Burgin | 100/37 |
| 4,483,248 | 11/1984 | Ostreng | 100/125 |
| 4,771,686 | 9/1988 | Triantos, Jr. | 100/255 |
| 4,927,085 | 5/1990 | Oberg | 241/36 |
| 5,039,294 | 8/1991 | Gautier et al. | 425/420 |
| 5,125,331 | 6/1992 | Wood | 100/37 |
| 5,188,848 | 2/1993 | Taddei | 425/419 |
| 5,391,069 | 2/1995 | Bendzick | 425/78 |

FOREIGN PATENT DOCUMENTS

| | | | |
|---|---|---|---|
| 617285 | 7/1978 | U.S.S.R. | 100/244 |
| 677951 | 8/1979 | U.S.S.R. | 100/209 |
| 1397133 | 6/1975 | United Kingdom | 100/186 |

*Primary Examiner*—Stephen F. Gerrity
*Attorney, Agent, or Firm*—Palmatier, Sjoquist, Helget & Voigt

[57] ABSTRACT

A two-stage compaction device for compressing residue metal waste and squeezing excess fluid from the waste, having a pre-compaction cylinder, a pair of compaction chambers, and a pair of die cylinders, all aligned along a common horizontal axis; each of the compaction chambers has an ejection plunger and ejection slot for removing compressed pellets of metal waste and for draining excess fluid accummulations. The pre-compaction cylinder and the die cylinders have pistons within the compaction chamber, and the actuation of the pistons is controlled to first compress residue waste material in one compaction chamber and then to compress residue metal waste material in the other compaction chamber while the ejection plunger is activated in the first chamber to eject the previously compressed pellet.

7 Claims, 4 Drawing Sheets

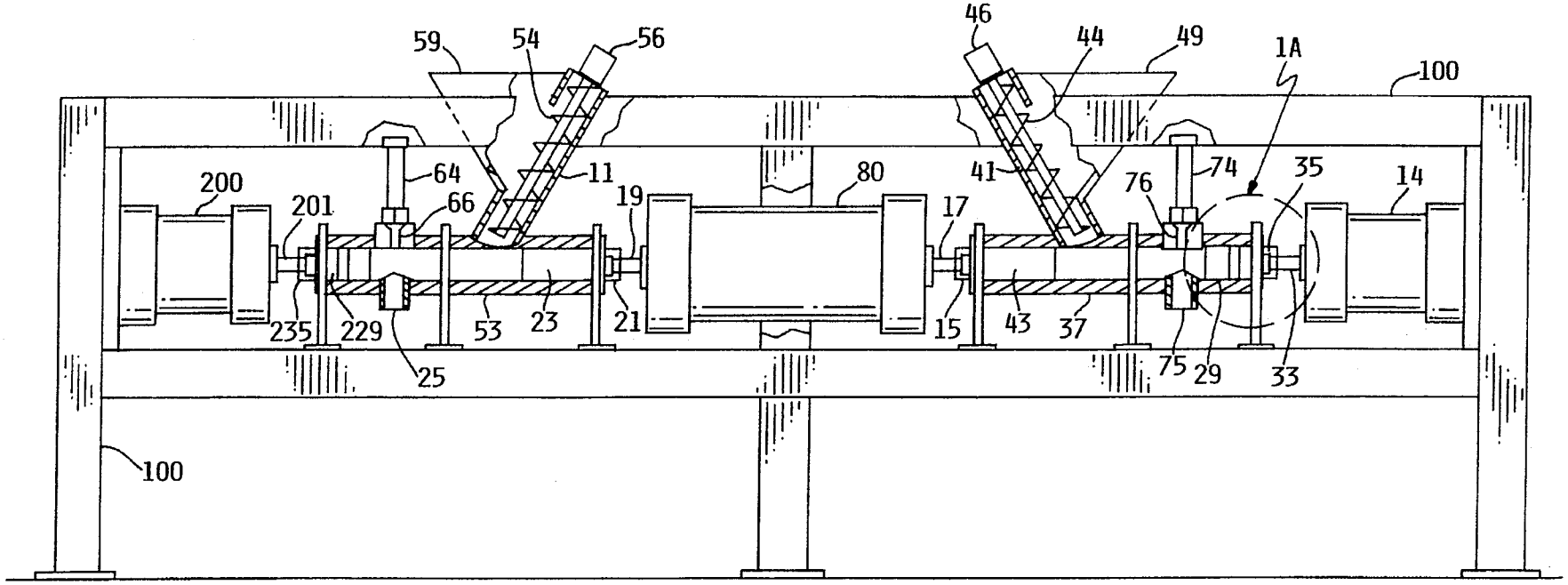
FIG. I
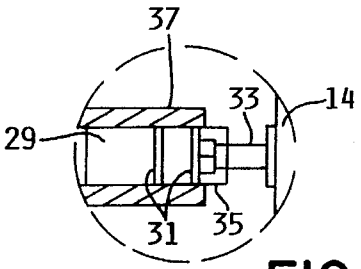
FIG. IA

DUAL HYDRAULIC CYLINDER COMPACTING APPARATUS

BACKGROUND OF THE INVENTION

This invention relates to an apparatus for compacting metal shavings and the like; more particularly, the invention relates to a dual chamber compactor utilizing opposing pistons in the compaction process.

U.S. Pat. No. 5,391,069, issued Feb. 21, 1995, discloses a single cylinder apparatus for compacting metal shavings; and the present invention is an improvement over this prior patent.

In industrial manufacturing shops it is common to utilize various types of metal cutting equipment to cut and shape metal for manufactured finished products. Such equipment utilizes cutting machines in combination with a fluid bath to produce a finished product, leaving a residue of waste consisting of a significant quantity of metal shavings, chips and fluid. The prior-referenced patent discloses an apparatus for compacting this residue, thereby squeezing excess fluid from the residue for collection and compacting the shavings and other metal residue into high density metal pellets. The metal pellets may be ejected from the machine and collected for recycling and the fluid squeezed from the residue is collected, filtered and returned to the machine for reuse.

The present invention effectively doubles the capacity of the device described in the prior patent by utilizing a single-cylinder pre-compaction device operated in reciprocal mode, in conjunction with a pair of compactor pistons, all placed along a common axis. It is the principal object of the present invention to provide a device for compacting metal shavings and the like with an increased load capacity and operating speed over the prior art.

It is another object and advantage of the present invention to provide a pre-compacting device utilizing a single cylinder aligned along an axis with two opposed reciprocal piston rods for driving pistons in respectively opposite directions in aligned compaction chambers.

SUMMARY OF THE INVENTION

The present invention uses a single cylinder having two piston rods reciprocable along an axis from either end of the cylinder, each of the piston rods attached to a pre-compacting piston. The respective pre-compacting pistons are slidably movable within respective compaction chambers, and each of the chambers has a second end for receiving a die piston. The respective die pistons are connected to a piston rod and hydraulic die cylinder, thereby providing reciprocal motion to the die pistons. A pair of kick-out cylinders are positioned orthogonally to the axis of the compaction chamber for ejecting the compacted pellet from the compaction chamber.

BRIEF DESCRIPTION OF THE DRAWINGS

The invention is best understood with reference to the following specification and claims and with reference to the appended drawings in which:

FIG. 1 shows an elevation view in partial cross section of the invention;

FIG. 1A shows an expanded view of a portion of FIG. 1;

DESCRIPTION OF THE PREFERRED EMBODIMENT

Figure 2:
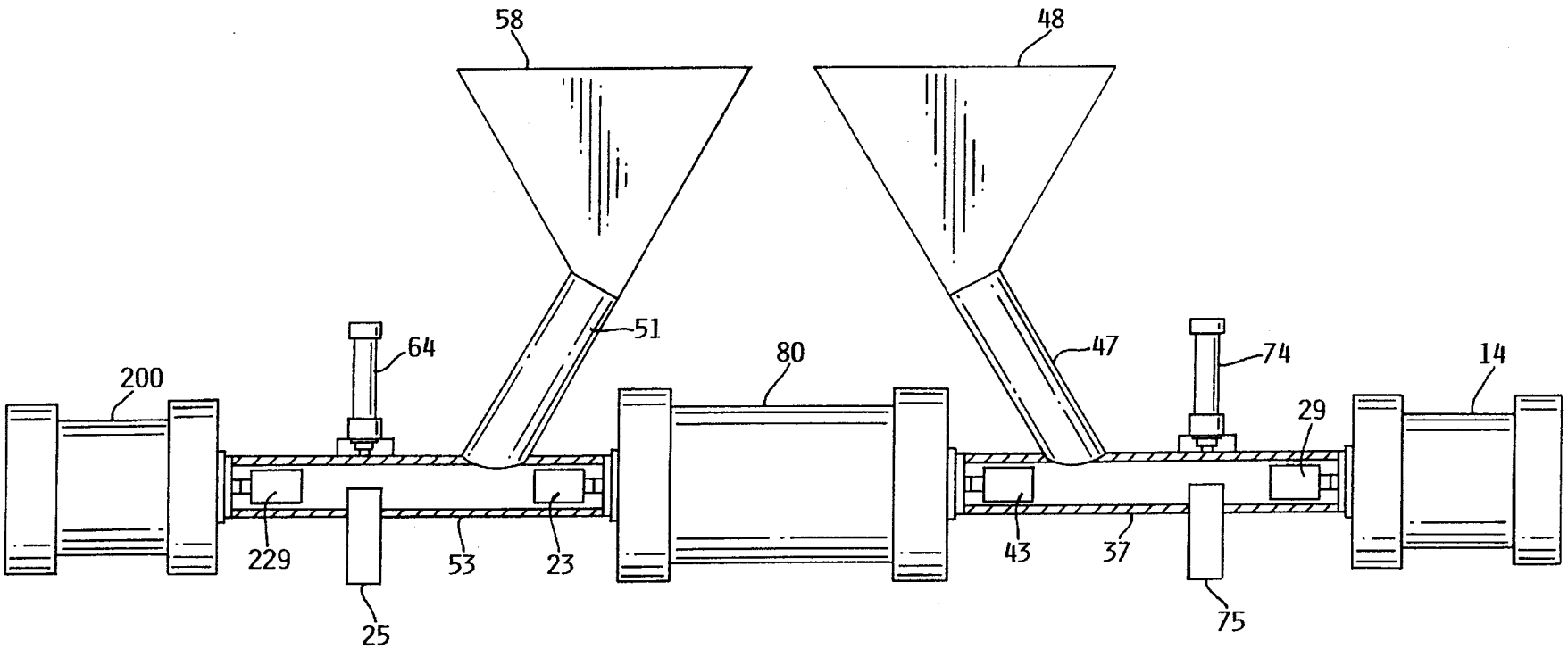
FIG. 2 shows a further elevation view in partial cross section.

Referring first to FIG. 1, there is shown an elevation view of the invention in partial cross section and breakaway. The invention is supported by a framework 100, preferably so as to place the components of the invention at an elevated position relative to the ground level. A number of hydraulic cylinders are affixed to framework 100 and aligned along a common axis. A first pre-compaction cylinder 80 is approximately centrally positioned along framework 100 and is horizontally aligned. Cylinder 810 has a cylinder rod 17 projecting from its right end and a cylinder rod 19 projecting from its left end. Cylinder rod 17 is connected to a pre-compaction piston 43 via a coupling link 15. Piston 43 is reciprocably movable within a cylinder 37 over the full range of movement of cylinder rod 17. Likewise, rod 19 is connected to a pre-compaction piston 23 via a coupling 21, and piston 23 is reciprocable within a cylinder 53 over the full range of reciprocable movement of rod 19. Cylinders 37 and 53 are otherwise known as compaction chambers 37 and 53, for they form the volume for compacting material to be hereinafter described.

A die cylinder 200 is affixed to framework 100 in alignment with compaction chamber 53. Die cylinder 200 is a hydraulic cylinder having a cylinder rod 201 projecting therefrom and connected to a die piston 229 via a coupling 235. Die piston 229 is reciprocably movable within compaction chamber 53 over the full range of reciprocable motion of cylinder rod 201.

A second die cylinder 14 is affixed to the right side of framework 100 in alignment with compaction chamber 37. Cylinder 14 has a cylinder rod 33 projecting therefrom, and cylinder rod 33 is connected to a die piston 29 via a coupling 35. The construction of these components is best seen in FIG. 1A which represents a partial exploded view of the same components. Die piston 29 has a pair of piston rings 31 circumferentially attached thereto to provide a tight seal against the inner wall of compaction chamber 37. A similar construction is found on die piston 229. The inwardly facing surfaces of the respective die pistons are typically formed with a raised pattern or design so that the raised pattern or design may be embossed into the compressed material pellet which is formed by operation of the invention.

A feed auger 11 is mounted to framework 100 and has a lower open end which opens into the interior of compaction chamber 53. An auger screw 54 is axially aligned within the feed auger 11 tube, and screw 54 is 10 turned by operation of a hydraulic motor 56. A feed hopper 59 opens into the screw passageway so that material dumped into the feed hopper 59 is moved downwardly through feed auger 11 and into the compaction chamber 53.

Similarly, a hopper 49 is affixed to framework 100 and opens into feed auger 41. Feed auger 41 has an internal screw 44 which is driven by hydraulic drive motor 46, and feed auger 41 opens into compaction chamber 37.

A pneumatic cylinder 64 is affixed to framework 100 and includes a reciprocable plunger 66 which is capable of being pneumatically inserted into compaction chamber 53. A pellet ejection slot 25 also opens into compaction chamber 53 generally in alignment with the path of travel of plunger 66.

The purpose of plunger 66 and pneumatic cylinder 64 is to cause the ejection of a compressed pellet after the pistons in the invention have suitably compressed the material into a pellet.

Similarly, a pneumatic cylinder 74 is fixed to framework 100 and is positioned orthogonally relative to compaction chamber 37. Cylinder 74 has a reciprocable plunger 76 which may be moved into the compaction chamber 37 to eject a pellet downwardly through pellet ejection slot 75.

FIG. 2 shows a view of a modified form of the invention with the framework deleted for clarity. In this view a modified form of hopper 58 is used to feed into the end of a feed auger 51, and a similar hopper 48 is used to feed into the end of a feed auger 47. Feed auger 51 opens into compaction chamber 53, and feed auger 47 opens into compaction chamber 37.

Figure 3A:
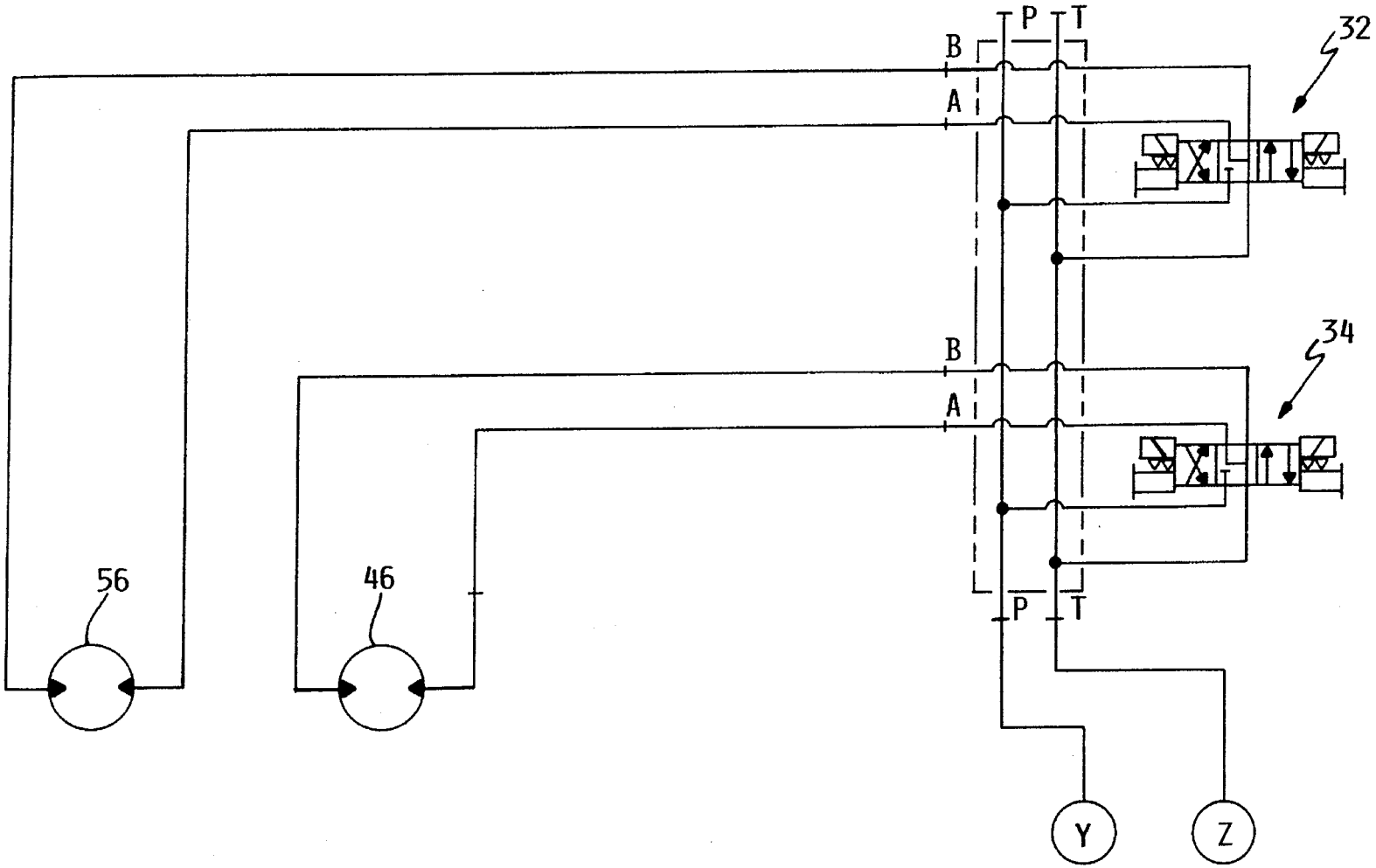
FIG. 3A shows the hydraulic circuits for operating the feed auger.
Figure 3B:
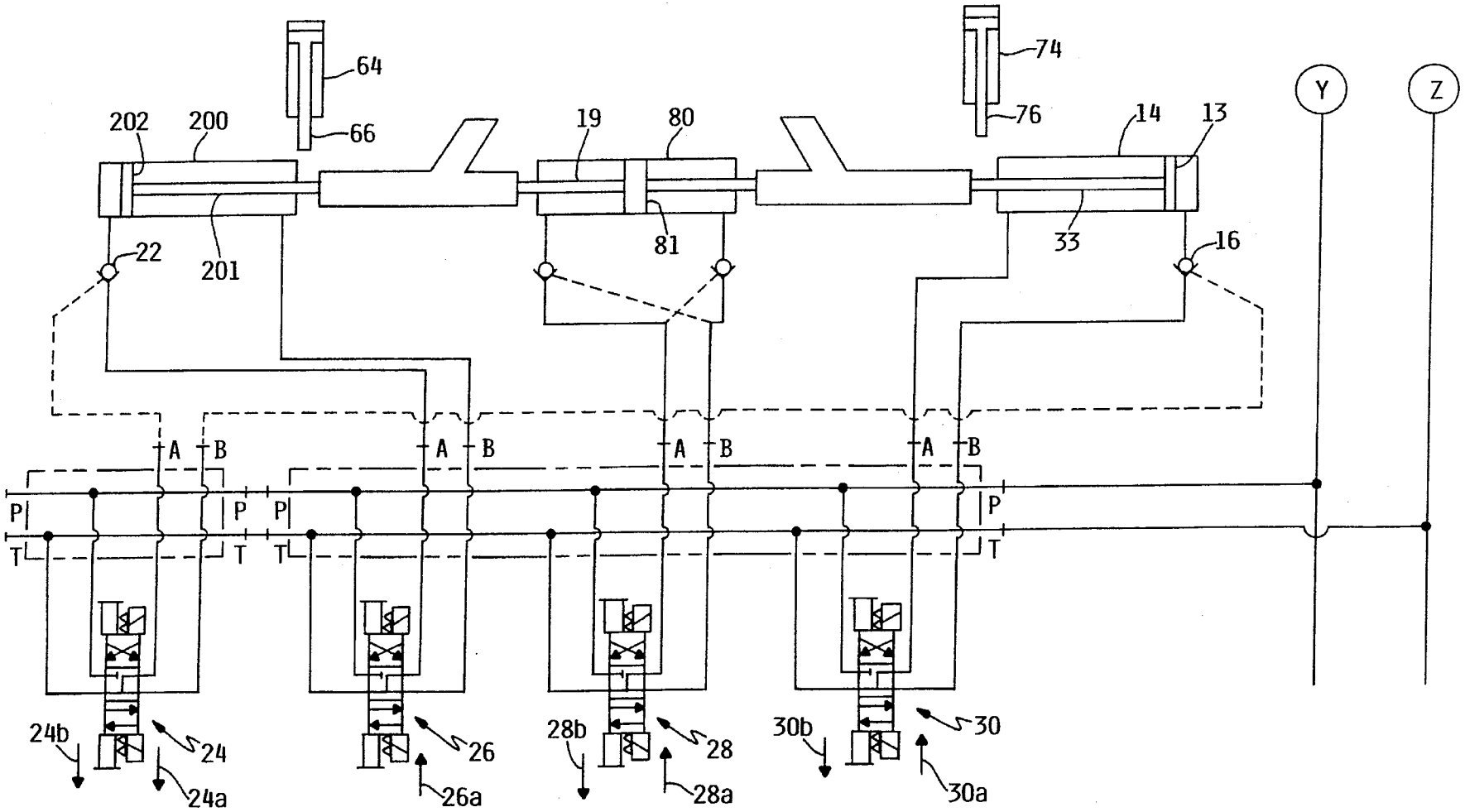
FIG. 3B shows the hydraulic circuits for operating the respective pistons.

The hydraulic controls which operate the cylinders of the present invention are shown with reference to FIG. 3A and FIG. 3B. These hydraulic controls largely consist of solenoid-operated hydraulic valves which regulate the flow of pressurized hydraulic fluid from a set of pressurized lines, identified as "P" lines, to a set of return lines, identified as "T" lines. Such pressurized lines are typically and commonly found in industrial plants where the invention may be utilized. The valves are operated in a particular sequence by a control mechanism (not shown) which is well within the scope of the prior art. One example of a control mechanism which could be used for this purpose is a suitably programmed microprocessor of the type generally known in the prior art. The sequence of operation described hereinafter is typical of the sequential control cycle which such a prior art microprocessor is capable of performing.

The valves 16, 18, 20 and 22 are pilot-operated check valves which permit the flow of fluid in only a single direction unless the pilot input lines are activated. In each case, the pilot input line is shown as a dotted line. Whenever pressurized fluid is provided to a pilot input line, the valve connected to that line becomes open for flow in either direction through the valve; whenever pressurized fluid is not supplied to the pilot line, the valve operates as a one-way check valve thereby permitting fluid flow in only one direction.

Pre-compaction cylinder 80 has pilot-operated check valves 18 and 20 connected to both hydraulic inputs wherein the respective pilot lines are coupled to the opposite input. In this case, whenever pressurized fluid is applied to either input line it causes the pilot valve associated with the other line to open thereby permitting bi-directional fluid flow through the other line.

A solenoid valve 32 is actuated to direct the flow of pressurized hydraulic fluid to hydraulic motor 56, thereby causing auger screw 54 to begin turning in auger 11, and feeding waste material collected in hopper 58 (59) into compaction chamber 53. This continues for a predetermined time, and valve 32 is deactuated (moved to center position). Next, solenoid valve 28 is actuated in the direction shown by arrow **28*b*, causing pressurized hydraulic fluid to flow into the right side of pre-compaction cylinder 80 and forcing piston 81 to move leftwardly. As piston 81 moves leftwardly, cylinder rod 19 forces pre-compaction piston 23 into compaction chamber 53, thereby compressing the waste material previously augered into chamber 53. This compression continues until a preselected pressure point is reached, which may be preset into a pressure relief valve (not shown) placed in the hydraulic line connected to cylinder 80**.

A pneumatic valve (not shown) is actuated to activate cylinder 74, thereby inserting plunger 76 into compaction chamber 37 to kick out the material previously compacted in this compaction chamber; cylinder 74 is momentarily actuated and then returned to its deactivated position after the previously compressed pellet in compaction chamber 37 has been ejected from pellet ejection slot 75.

Solenoid valve 26 is next actuated in the direction shown by arrow **26*a*, thereby causing pressurized hydraulic fluid to flow through pilot check valve 22 and into the left side of die cylinder 200, and relieving pressurized hydraulic fluid from the right side of die cylinder 200. Die cylinder piston 202 moves rightwardly, causing cylinder rod 201 to move die piston 229 further into compaction chamber 53 and further compressing the material in compaction chamber 53. At the same time, solenoid valve 24 is actuated in the direction shown by arrow 24*a* to cause pilot check valve 22 to open (solenoid valve 30 is actuated in the direction shown by arrow 30*b*, thereby causing pressurized hydraulic fluid to flow into the right side of die cylinder 14 and forcing die cylinder piston 13 leftwardly and extending die piston 29 partially into compaction chamber 37**, placing it in the load position for the next cycle).

Next, solenoid valve 26 is returned to its center position, thereby relieving hydraulic fluid pressure and hydraulic shock, from both sides of piston 202 (pilot valve 22 being opened), and the continuing force of piston 81 causes the compressed pellet to slide into position over pellet ejection slot 25, which is the fully extended position of cylinder rod 19 (it should be noted that a position sensor could be installed on cylinder 200 to monitor the position of die piston 229, and this would provide a means for determining the thickness of the compressed pellet at this time).

Solenoid valve 34 is next actuated, causing activation of hydraulic motor 46, which feeds material from hopper 48 (49) into compaction chamber 37 for a predetermined time. After solenoid valve 34 has been deactuated (moved to center position), solenoid valve 28 is actuated in the direction shown by arrow **28*a*, thereby causing the flow of pressurized hydraulic fluid into the left side of pre-compaction cylinder 80. This causes piston 81 to move rightwardly and compresses the material in compaction chamber 37** to a predetermined pressure, as described earlier.

Pneumatic cylinder 64 is actuated, causing plunger 66 to enter compaction chamber 53 and eject the compressed pellet from compaction chamber 53.

Solenoid valve 30 is actuated in the direction shown by arrow **30*b*, thereby causing pressurized hydraulic fluid to flow into the right side of die cylinder 14, and causing piston 13 to move leftwardly to further compress the material in compaction chamber 37. Solenoid valve 30 is then returned to its center position, thereby relieving pressure from both sides of piston 13 (solenoid valve 24 is also actuated in the direction shown by arrow 24*b* to open pilot check valve 16, to provide the pressure relief from both sides of the piston 13). The continuing force of piston 81 causes the compressed pellet in compaction chamber 37 to move rightwardly into position over ejection slot 75 (again, a position sensor could be mounted to cylinder 14 to monitor the position of die piston 29** to provide a measure of the thickness of the compressed pellet).

The foregoing sequence is repeated as needed, to alternately provide compressed pellets from ejection slots 25 and 75. During the compression steps, any fluid accumulation in the residue material is squeezed out through ejection slots 25 and 75, and a suitable collection reservoir can be provided beneath these slots to collect the fluid.

Although the invention has been described with reference to the preferred embodiment thereof, it is apparent that persons skilled in the art may make modifications and changes within the essential spirit and scope of the invention.

What is claimed is:

1. A two-stage compactor for compressing metal waste residue into metal pellets, comprising:

a) an elevated framework positioned along a generally horizontal axis;

b) a pre-compaction cylinder affixed to said framework, and having opposed cylinder rods aligned along said axis, with pre-compaction pistons respectively coupled to the ends of said cylinder rods;

c) a pair of compaction chambers respectively aligned along said axis, each of said compaction chambers positioned to receive one of said pre-compaction pistons;

d) a pair of die cylinders aligned along said axis, each of said die cylinders having a die cylinder piston connected to a first end of a cylinder rod, with respective die piston connected to a second end of said cylinder rod and projecting into one of said compaction chambers in facing relationship to one of said pre-compaction pistons;

e) an auger opening into each of said compaction chambers between said die piston and said pre-compaction piston, and a feed hopper connected to each of said augers;

f) means for actuating said pre-compaction cylinder in concert with said die cylinders, whereby said pre-compaction piston and said die piston in a first one of said compaction chambers are moved toward each other in a first operational stage, and said pre-compaction piston and said die piston in a second one of said compaction chambers are moved toward each other in a second operational stage; and g) an ejection plunger and ejection slot aligned orthoganol to each of said compaction chambers, and means for actuating said plungers to eject compressed material from respective compaction chambers.

2. The apparatus of claim 1, wherein said pre-compaction cylinder further comprises a single piston slidably arranged in a cylinder, with cylinder rods respectively projecting from opposite sides of said single piston.

3. The apparatus of claim 2, wherein each of said augers further comprises a screw mounted in an auger tube positioned above said compaction chamber.

4. The apparatus of claim 3, wherein each of said die pistons further comprise a surface facing inward in said compaction chamber, said surface having a raised design thereon.

5. The apparatus of claim 4, wherein said means for actuating further comprises solenoid valves respectively coupled between said cylinders and a source of pressurized hydraulic fluid.

6. The apparatus of claim 5, further comprising a hydraulic motor connected to each of said auger screws, and means for selectively activating said hydraulic motor.

7. The apparatus of claim 6, wherein said means for actuating further comprises a solenoid valve connected between said hydraulic motor and a source of pressurized hydraulic fluid.

* * * * *

UNITED STATES PATENT AND TRADEMARK OFFICE

CERTIFICATE OF CORRECTION

PATENT NO. : 5,524,534

DATED : June 11, 1996

INVENTOR(S) : Dale G. Dietel

It is certified that error appears in the above-indentified patent and that said Letters Patent is hereby corrected as shown below:

Column 2, line 17, please delete the numeral "810" and insert in its place --80--.

Column 2, line 53, please delete the numeral "10".

Signed and Sealed this

Twenty-seventh Day of August, 1996

*Attest:*

Bruce Lehman

BRUCE LEHMAN

*Attesting Officer*

*Commissioner of Patents and Trademarks*